US007360484B1

(12) United States Patent
Murray et al.

(10) Patent No.: US 7,360,484 B1
(45) Date of Patent: Apr. 22, 2008

(54) SELF-STANDING ALUMINUM CAN CRUSHING DEVICE

(76) Inventors: John A. Murray, 2251 Flinn Rd., Manning, SC (US) 29102; Everlena C. Murray, 2251 Flinn Rd., Manning, SC (US) 29102

( * ) Notice: Subject to any disclaimer, the term of this patent is extended or adjusted under 35 U.S.C. 154(b) by 0 days.

(21) Appl. No.: 11/633,295

(22) Filed: Dec. 4, 2006

(51) Int. Cl.
*B30B 9/32* (2006.01)

(52) U.S. Cl. ..... 100/245; 100/265; 100/266; 100/902

(58) Field of Classification Search ..... 100/214, 100/240, 245, 260, 265, 266, 292, 902; 99/578
See application file for complete search history.

(56) References Cited

U.S. PATENT DOCUMENTS 3,009,414 A * 11/1961 Griemert ..... 100/293
4,188,875 A 2/1980 Fabbri et al.
4,393,765 A 7/1983 Accettura et al.
4,417,512 A * 11/1983 Engelke ..... 100/266
5,058,498 A 10/1991 Chen
5,584,239 A 12/1996 Yelczyn et al.
D396,049 S 7/1998 Chadwick
5,848,569 A 12/1998 Maki et al.
6,481,346 B1 * 11/2002 Miller ..... 100/269.13

OTHER PUBLICATIONS

Harriet Carter, Can Crusher, http://www.harrietcarter.com/Detail.cfm?prod=8484&UDC=Y, Apr. 12, 2006.

* cited by examiner

*Primary Examiner*—Jimmy T. Nguyen
(74) *Attorney, Agent, or Firm*—Kyle Fletcher

(57) ABSTRACT

The present invention is a self-standing unit designed to compact aluminum cans. A stand is connected to a vertical housing, which is hollowed out and contains a can slot, a slot for a handle, and a plurality of slots for a plurality of springs to operate. Connected to the vertical member are the springs, which also connect to a crushing device. The crushing device fits inside the hollow section of the vertical member and has the handle located near the top of it. The invention is spring loaded so that the can slot normally stays open for placing a can inside to be crushed.

3 Claims, 2 Drawing Sheets

FIG. 1
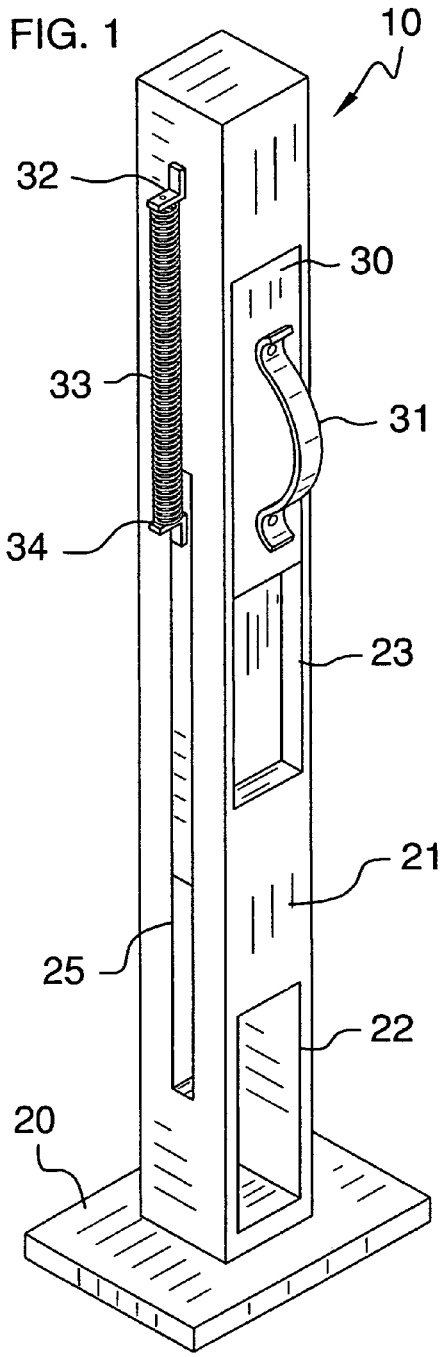
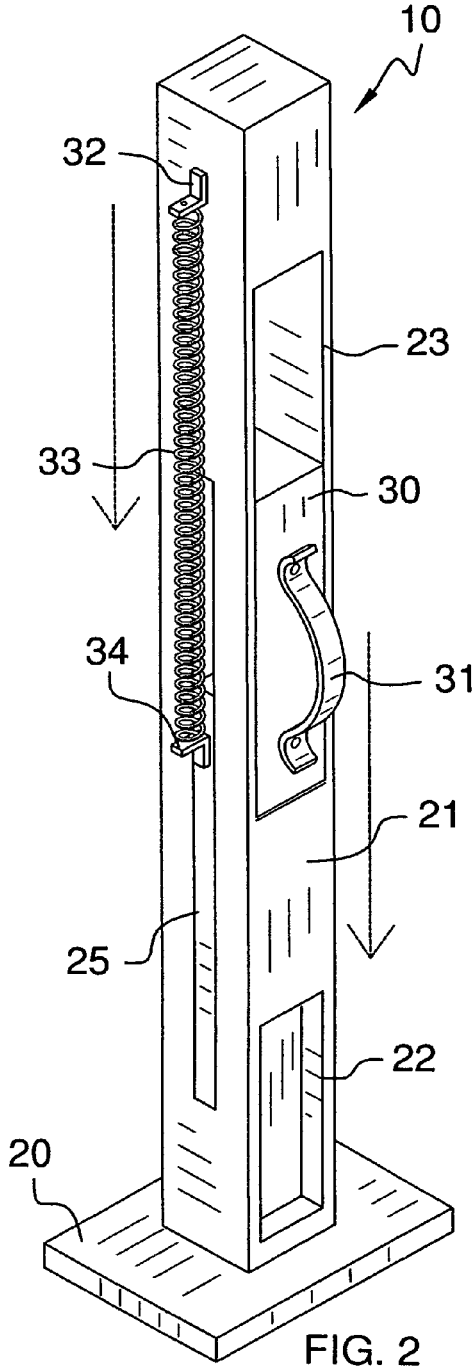
FIG. 2

SELF-STANDING ALUMINUM CAN CRUSHING DEVICE

BACKGROUND OF THE INVENTION

1. Field of the Invention

The present invention is a self-contained unit designed to manually compact aluminum cans.

2. Prior Art

The Yelczyn et al. Patent (U.S. Pat. No. 5,584,239) is directed to a pivoted can crusher with a handle.

The Accettura et al. Patent (U.S. Pat. No. 4,393,765) is directed to an aluminum can compactor where the can rests between a series of legs.

The Chen Patent (U.S. Pat. No. 5,058,498) is directed to the structure of an aluminum can crusher having a driving gear mounted on a movable axle.

The Fabbri et al. Patent (U.S. Pat. No. 4,188,875) is directed to a manually operated press for crushing aluminum cans.

The Maki et al. Patent (U.S. Pat. No. 5,848,569) is directed to a manually operated crushing device.

The Can Crusher is another piece of prior art that is not patent related, but illustrates a wall-mounted can crusher using a pivot.

BRIEF SUMMARY OF THE INVENTION

The present invention relates to a self-standing unit designed to compact aluminum cans. A stand is connected to a vertical housing, which is hollowed out and contains a can slot, a slot for a handle, and a plurality of slots for a plurality of springs to operate. Connected to the vertical member are the springs, which also connect to a crushing device. The crushing device fits inside the hollow section of the vertical member and has the handle located near the top of it. The invention is spring loaded so that the can slot normally stays open for placing a can inside to be crushed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIG. 1 illustrates an isometric view of the invention by itself;

FIG. 2 illustrates an isometric view of the invention with the crushing device in the down position;

DETAILED DESCRIPTION OF THE EMBODIMENT

Figure 3:
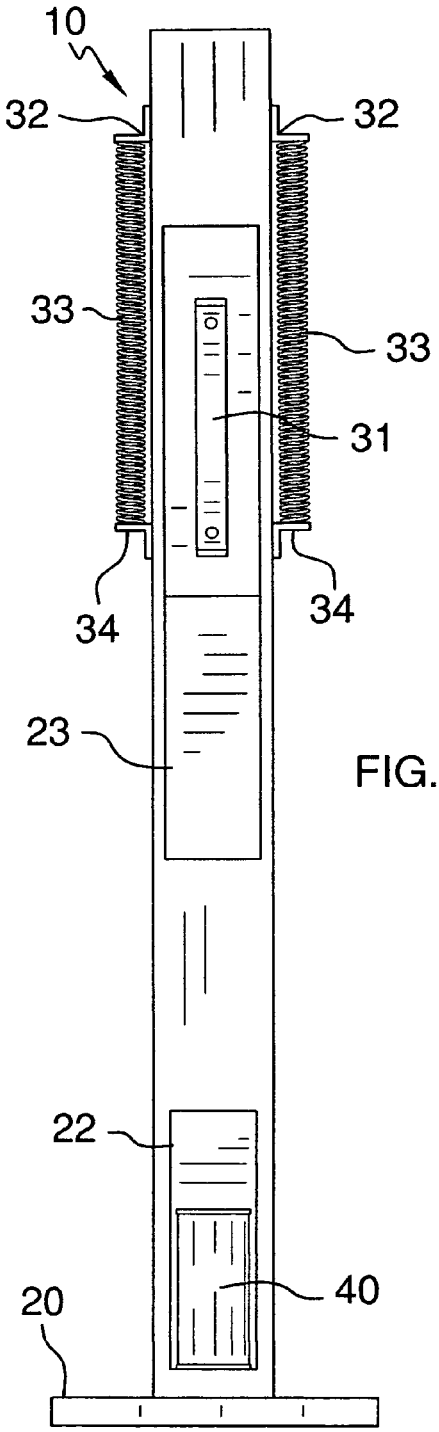
FIG. 3 illustrates a rear-side view of the invention by itself.
Figure 4:
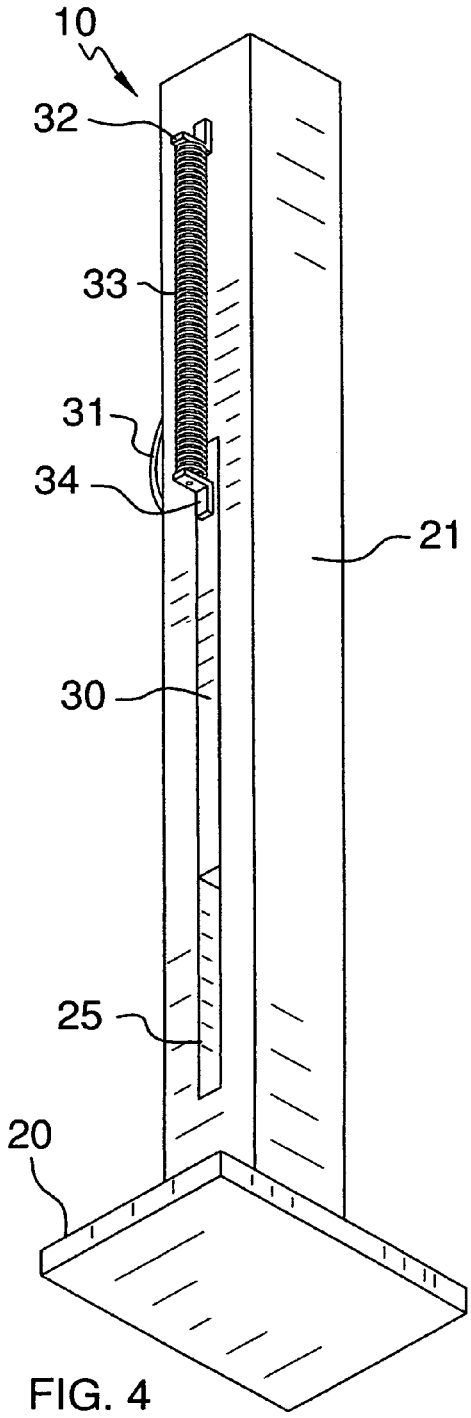
FIG. 4 illustrates a rear-isometric view of the invention by itself.

Detailed reference will now be made to the preferred embodiment of the present invention, examples of which are illustrated in FIGS. 1-4.

An invention 10 has a base 20 that is connected to a vertical housing 21. The vertical housing 21 is hollowed out, contains a can slot 22, and a handle slot 23. The vertical housing 21 also contains left and right side openings 25. A crushing device 30 fits inside of the hollowed section of the vertical member 21. At the top of the crushing device 30 is a handle 31. Attached near the top of the left and right side of the vertical housing 21 is a vertical housing angle bracket 32. Attached to each vertical housing angle bracket 32 is a spring 33. Connected to the other end of each spring 33 is a crushing device angle bracket 34.

In operation, the invention 10 operates by placing an aluminum can 40 inside of the can slot 22, and pushing the handle 31 toward the base 20. Once the aluminum can 40 is crushed, the springs 33 will raise the crushing device 30, and the crushed aluminum can 40 can be removed from the can slot 22.

The inventor claims:

1. A self-standing aluminum can compacting device comprising:

(a) a base;

(b) a crushing device;

(c) a plurality of angle brackets are attached at a prescribed point alongside a left side, and a right side of the crushing device;

(d) a handle is attached to the crushing device and the handle is positioned near a top of the crushing device;

(e) a vertical housing is positioned above the base, the vertical housing comprises a hollowed interior, in which the crushing device is slidable therein, the vertical housing comprises an opening at a bottom thereof defining a can slot, the vertical housing comprises another opening for the handle of the crushing device to move up and down, the another opening is positioned directly above the opening defining the can slot, the vertical housing further comprises a plurality of openings for the angle brackets of the crushing device to move up and down, wherein the vertical housing having a plurality of angle brackets attached thereto, the angle brackets of vertical housing are positioned on an exterior of the vertical housing and near a top of the vertical housing, and each of the angle brackets of vertical housing is aligned above the respective opening for the angle brackets that are attached to the crushing device; and (f) a plurality of springs, each of the springs having one end attached to the respective angle bracket of the vertical housing and an opposite end attached the respective angle bracket located on the crushing device.

2. The aluminum can compacting device as described in claim 1 is operated by placing an aluminum can in the can slot of the vertical housing, then pushing the handle of the cursing device in the direction of the base until the crushing device compacts the aluminum can, then allowing the springs to return the crushing device to the up position, and then removing the crushed aluminum can.

3. The aluminum can compacting device of claim 1 is made of materials comprising wood, metal, and plastic.

* * * * *